US006693389B2

(12) United States Patent
Marcotte et al.

(10) Patent No.: US 6,693,389 B2
(45) Date of Patent: Feb. 17, 2004

(54) SUPPRESSION OF VERTICAL CROSSTALK IN A PLASMA DISPLAY PANEL

(75) Inventors: Robert G. Marcotte, New Paltz, NY (US); Norifusa Isobe, New Paltz, NY (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/305,560

(22) Filed: Nov. 27, 2002

(65) Prior Publication Data

US 2003/0102812 A1 Jun. 5, 2003

Related U.S. Application Data

(60) Provisional application No. 60/341,506, filed on Nov. 30, 2001.

(51) Int. Cl.[7] ..... G09G 3/28
(52) U.S. Cl. ..... 315/169.4; 345/67; 345/68
(58) Field of Search ..... 315/169.4, 169.1; 345/67, 68

(56) References Cited

U.S. PATENT DOCUMENTS

| | | | | |
|---|---|---|---|---|
| 5,724,054 A | | 3/1998 | Shinoda | 345/60 |
| 5,745,086 A | | 4/1998 | Weber | 345/63 |
| 5,805,122 A | | 9/1998 | Bongaerts et al. | 345/60 |
| 6,088,009 A | * | 7/2000 | Moon | 345/60 |
| 6,118,214 A | | 9/2000 | Marcotte | 313/582 |
| 6,184,848 B1 | | 2/2001 | Weber | 345/60 |

FOREIGN PATENT DOCUMENTS

EP 0 762 373 3/1997

OTHER PUBLICATIONS

International Search Report. PCT Application Serial No. PCT/IB02/05451, Filed Nov. 27, 2002.

"Symmetrically driven PDP, with minimised current loops to reduce EMI" Vossen, et al., Asia Display/IDW'01; pp. 993–996.

* cited by examiner

*Primary Examiner*—David Hung Vu
(74) *Attorney, Agent, or Firm*—Ohlandt, Greeley, Ruggiero & Perle, LLP

(57) ABSTRACT

There is provided a method for controlling sustain electrodes in a plasma display panel (PDP). The method includes enabling a first sustain electrode to produce an addressing discharge, and disabling a second sustain electrode when the first sustain electrode is producing the addressing discharge. The first sustain electrode is adjacent to the second sustain electrode.

21 Claims, 15 Drawing Sheets

(Prior Art)

SUPPRESSION OF VERTICAL CROSSTALK IN A PLASMA DISPLAY PANEL

CROSS REFERENCE TO RELATED APPLICATIONS

The present application is claiming priority of U.S. Provisional Patent Application Ser. No. 60/341,506, filed on Nov. 30, 2001.

BACKGROUND OF THE INVENTION

1. Field of the Invention

The present invention relates to plasma display panels (PDPs), and more particularly, to an electronic waveform technique that minimizes vertical crosstalk in a PDP.

2. Background of the Art

Color PDPs are well known. FIG. 1 illustrates a prior art embodiment of a color alternating current (AC) PDP, as disclosed in U.S. Pat. No. 6,118,214 to Marcotte (hereinafter "the Marcotte '214 patent"), which is incorporated herein by reference. Transparent electrodes 11 are employed on a front panel. A front plate (not shown) includes horizontal plural pairs of sustain electrodes 10 that connect transparent electrodes 11 to a sustain bus 12. A plurality of pairs of scan electrodes 14 are juxtaposed to paired sustain electrodes 10, and both electrode sets are covered by a dielectric layer (not shown) and a magnesium oxide (MgO) layer (not shown). A back plate (not shown) supports vertical barrier ribs 16 and plural vertical column electrodes 18 (shown in phantom). Individual column electrodes 18 are covered with red, green, or blue (RGB) phosphors, as the case may be, to enable a full color display to be achieved. The front and rear plates are sealed together and a space therebetween is filled with a dischargeable gas.

An electrode pair is defined as (a) a sustain electrode 10 (and its adjacent transparent electrode 11) juxtaposed with (b) a scan electrode 14 (and its adjacent transparent electrode 11). A pixel 20 is defined as an area that includes intersections of (i) an electrode pair of sustain electrode 10 and scan electrode 14 on the front panel, and (ii) three column electrodes 18 for red, green, and blue, respectively, on the back panel. A subpixel corresponds to an intersection of a red, green or blue column electrode with an electrode pair of a sustain electrode and a scan electrode. For example, subpixel 19 corresponds to an intersection of a red column electrode 18 with an electrode pair of sustain electrode 10 and scan electrode 14.

Operating voltage and power of the PDP are controlled by a discharge gap 13 and a width of transparent electrode 11. The operating voltage of the PDP is controlled by the distance across the discharge gap 13, as the distance controls the breakdown voltage for a given gas mixture. Furthermore, sufficient voltage must be applied so that the ensuing gas discharge plasma is able to fully engulf the scan and sustain electrode pair. The power consumed by the discharge is affected by the surface capacitance of the electrode pair, which is proportional to electrode area and inversely proportional to the dielectric thickness.

A width of sustain electrode 10 and a width of scan electrode 14 are chosen to produce a narrow discharge gap 13 and a wide inter-pixel gap 15. When sufficient voltage is applied across discharge gap 13, the gas will break down forming a discharge plasma. For a given applied voltage, the positively charged electrode is the anode and the negatively charged electrode is the cathode. The discharge plasma has two distinct regions, the positive column and the negative glow. The positive column consists predominantly of fast moving electrons seeking the positive charge on the surface of the anode electrode. Conversely, the negative glow contains slow moving ions drifting toward and across the negatively charged cathode electrode. The duration of the discharge is limited by the amount of charge on the dielectric surfaces. Once the charge has been neutralized the discharge self-extinguishes. Within a sustain time period, this process is repeated by alternating the voltage polarity after each discharge completes. Inter-pixel gap 15 must be made sufficiently large to prevent the energetic positive column of the plasma discharge from bridging the inter-pixel gap and corrupting an ON or OFF state of an adjacent pixel. The width of the transparent electrode 11 and the thickness of a dielectric glass (not shown) over the electrode determine the pixel's discharge capacitance, which controls the discharge power and therefore brightness. For a given discharge power/brightness, a number of discharges is chosen within sustain time periods to provide gray scales which sum to meet the overall brightness requirement for the panel.

FIG. 2 shows a typical prior art block diagram of a PDP system 200. An analog video signal is input into logic 230 where the signal is digitized, processed, and temporarily stored. Once a frame's worth of data is stored, logic 230 begins a process of displaying data through a series of subfields, typically 8 to 12, as disclosed in U.S. Pat. No. 5,724,054 to Shinoda.

FIG. 3 is a graph showing a division of a frame time into 8 subfields (i.e., SF1–SF8). During each addressing period lines Y1 through Y480 are scanned sequentially by row drivers 210, while video input is applied through column drivers 225 to set each sub-pixel in the ON state as required by the video input. Each subsequent sustain period is weighted with sustain pulses to achieve weighted light intensities for each subfield.

FIG. 4 shows a typical division of a subfield. Each subfield has a setup period, an addressing period, and a sustain period. The setup period turns off any ON pixels, primes the MgO layer, and sets up all the pixels for addressing. Referring to both FIG. 2 and FIG. 4, during the addressing period, a scan generator 205, in conjunction with row drivers 210, sequentially drives each row low for addressing. Once a given row is enabled, logic 230 loads column drivers 225 with image data corresponding to individual RGB sub-pixels requiring illumination based upon received image data. Column drivers 225 apply voltage Vx to selected column electrodes. The coincidence of a selected row and an applied column voltage initiates a weak discharge that cascades into a discharge between the selected scan electrode and its neighboring sustain electrode. Once completed, the discharge has placed the addressed sub-pixel in the ON state. Any column not driven will remain in the OFF state. While the addressing discharge does produce visible light, it is not of sufficient brightness to represent the image properly. Consequently, a sustain period follows the addressing period after the last row has been addressed. During the sustain period, scan generator 205 and a sustain generator 220 supply alternating sustain pulses so that a momentary ac-plasma discharge occurs on an application of each pulse. Each sustain discharge produces ultra violet light the excites surrounding phosphor to produce visible light. Each subfield within a frame contains a sufficient number of sustain pulses and in-turn discharges to achieve a desired brightness for each subfield. Since each sub-pixel can be addressed independently in each subfield, a large color palate is obtainable.

FIG. 5*a* shows a prior art composite waveform between the scan and sustain electrodes. Due to a capacitive relationship of the scan and sustain electrodes, the composite waveform is simply an output of scan generator 205 (FIG. 4 Scan waveform), minus an output of sustain generator 220 (FIG. 4 Sustain waveform). Note that applied data pulses are not included in FIG. 5*a*.

FIGS. 5*b*–5*e* show wall voltage waveforms for each pixel addressing sequence. A wall voltage is an AC coupled voltage present on a gas side of a dielectric layer. The wall voltage is limited, positive and negative, by a breakdown voltage of the gas, Vbr and −Vbr.

When the breakdown voltage is exceeded in either direction, two types of discharges can occur, a well-known negative resistance discharge and a more recently discovered positive resistance discharge. According to U.S. Pat. No. 5,745,086 to Weber, and referring to FIG. 4, if an applied waveform rises or falls slowly, as in rising and falling ramps of the setup period t12 and t15, the gas will discharge having a positive resistance characteristic, behaving much like a zener diode limiting the voltage across the gas to the breakdown voltage Vbr. If the applied voltage exceeds the breakdown voltage sharply, as in the sustain periods t23, t24, a negative resistance or avalanche discharge occurs, which reduces the wall voltage to zero. Once the wall voltage reaches zero, the discharge self extinguishes.

The addressing discharge is also a negative resistance discharge, exhibiting the characteristics of a positive column discharge as disclosed in U.S. Pat. No. 6,184,848 to Weber (hereinafter "the Weber '848 patent"). The Weber '848 patent defines the positive column discharge as having a trigger cell and a state cell. A panel topology is similar to that of FIG. 1, but less transparent electrodes 11 thereby creating a large discharge gap. In the presence of a high wall voltage, due to an application of sustain pulses following an addressing operation, a weak discharge forms between a positively charged back plate electrode and a negatively charged front electrode. This intersection is said to be a trigger cell. The weak discharge, in conjunction with the high wall voltage, yields a discharge where the plasma forms two clearly distinct regions, a negative glow and a positive column. The negative glow consists of slow moving positively charged ions, and the positive column consists of slow moving ions and rapidly moving electrons. The electrons move toward the positively charged anode, and the ions drift slowly toward the negatively charged cathode. As the weak discharge strengthens, the negative glow expands about the trigger cell, and the positive column spreads along the back plate's phosphor layer to the positively charged state cell. The discharge completes when the charge is neutralized between the trigger cell and the state cell.

For the addressing discharge, the intersection of the column electrode and the selected scan electrode forms the trigger cell, and the corresponding sustain electrode intersecting with the same column electrode forms the state cell. At the completion of the setup period t16, each pixel is setup so that wall voltage is at the discharge level −Vbr. When the pixel is addressed, a weak discharge forms at the intersection of the selected scan electrode and at each of the driven back plate column electrodes. The discharge develops producing a positive column which spreads along the positively charged back plate electrode to the positively charged sustain electrode. The discharge then consumes the charge on the sustain electrode, reducing the wall voltage to zero.

FIG. 5*b* shows wall voltages for a previously OFF pixel, which is setup for addressing, not addressed, and remains OFF in a latter sustain period. Specifically, a rising ramp t12 in a setup period rises, bringing the wall voltage above the breakdown voltage and clamps the wall voltage at Vbr. Voltage Ve being applied at t13, as shown in FIG. 4, ensures that an address discharge will be strong enough for a first sustain discharge to occur properly. Increasing voltage Ve effectively makes the first sustain discharge stronger. A transition into the falling ramp t13 and t14 reverses the wall voltage and the falling ramp t15 clamps the wall voltage at −Vbr. At the conclusion of the setup period, the wall voltage is at −Vbr. A row select pulse at time t17 in FIG. 4 exceeds the breakdown voltage slightly due to a difference between Vrf and 0V. Since the falling ramp during time t15 stops at Vrf above 0V, a small negative voltage is effectively applied when the row select pulse is applied at time t17 to exceed the breakdown voltage —Vbr. Since this effective negative voltage, caused by Vrf is small and the width of the row select pulse at t17 is narrow, no discharge activity occurs unless there is a video input dictated data pulse on a data electrode coincident with the row select pulse at time t17 as shown in FIG. 4. In FIG. 5*b*, no data pulse is applied, and so there is no discharge activity at time t17. Since an address discharge did not occur, the wall voltage produced by the first sustain pulse at t21 is not greater the positive breakdown voltage Vbr and no sustain discharge will occur.

FIG. 5*c* shows the turn-on process for an OFF pixel. The setup period occurs as in FIG. 5*b* and a data pulse (not shown) is applied to the columns at time t17 triggering an address discharge which returns the wall voltage to zero. Later at time t21, after the remaining rows have been addressed, the first sustain discharge will occur on any pixel which was addressed. For the first sustain pulse, the scan electrode is driven high before lowering the sustain electrodes, unlike subsequent sustain pulses. This method of generating the first discharge prevents a premature discharge, which can form if the sustain electrode voltage of Ve, 220V is lowered before raising the scan electrode voltage to sustain voltage Vs, 180V, due to the application of voltage Ve in the setup period as shown in FIG. 4 during addressing. Having been addressed previously, the breakdown voltage Vbr is exceeded, and a negative resistance discharge will occur, again returning the wall voltage to zero. Each subsequent sustain pulse initiates another discharge producing the light of an ON pixel.

Following the first sustain discharge, the falling edge of the scan electrodes lowers the wall voltage towards the negative breakdown voltage −Vbr. The subsequent rise of the other sustain electrodes adds more voltage across the gas and exceeds the breakdown voltage −Vbr, producing the next discharge. This process continues for the duration of the sustain period with the discharges alternating back and forth.

FIG. 5*d* shows a re-addressing of an ON pixel. The application of the setup pulse at time t11 causes the last negative resistance discharge of the previous subfield's sustain period. Since the wall voltage was returned to zero by the discharge, the rising ramp at t12 will not discharge since the rising wall voltage does not exceed Vbr. The falling ramp limits the wall voltage to −Vbr, as it did in FIGS. 5*b* and 5*c*. At time t17, a data pulse is applied with the row select, a discharge occurs, and the pixel is returned to the ON state.

FIG. 5*e* shows an ON pixel which is erased by the falling ramp t15 as in FIG. 5*d*, however it is not re-addressed, and is OFF in the latter sustain period.

As disclosed in the Marcotte '214 patent, the paired front plate electrode configuration of FIG. 1 has the advantage of reduced inter-electrode capacitance, which reduces the power dissipation resulting from charging and discharging of the inter-electrode capacitance with each sustain pulse. However, there is an increased probability of vertical crosstalk. Vertical crosstalk occurs when a discharge at one discharge site spreads into a vertically adjacent discharge site. The Marcotte '214 patent utilizes a large inter-pixel gap to help increase vertical pixel-to-pixel isolation. Note that the back plate barrier ribs provide horizontal pixel isolation but no vertical isolation. The greatest probability of crosstalk occurs during the addressing discharge where the plasma discharge forms between a selected scan and data electrodes and the positive column spreads to the sustain electrode.

FIG. 6 shows the time sequenced discharge mechanics for an address discharge showing crosstalk discharge. The pictorial is a cross sectional view the PDP of FIG. 1 showing front plate electrodes on top and orthogonally oriented address electrode on the bottom, which is covered by a phosphor layer. P1 refers to the red sub-pixel 19 of FIG. 1 and a vertically adjacent red sub-pixel, P2 with inter-pixel gap 15 separating P1 and P2. The time t0 for each row occurs with the application of the row select pulse at time t17 in conjunction with an applied data pulse to the address electrode. The sub-pixels were setup by the falling ramp applied to the scan electrodes while Ve was applied to the sustain electrodes. This places the negative charge on the scan electrodes and the positive charge on the sustain and back plate electrodes prior to t0. Vrf allows the row select pulse to slightly exceed the breakdown voltage to help speed up the address discharge. The application of voltage Vscan at time t16, in FIG. 4, by the row drivers 210, acts as a row deselect voltage by reducing the negative charge on the non-selected rows so that the wall voltage on the scan electrodes is reduced. This prevents the addressing of one row from affecting the other rows in the display. The full wall voltage returns at time t17 when the row is selected, and the breakdown voltage —Vbr is exceeded as shown in FIG. 5*b*. The Vscan voltage is a de-select voltage and must be high enough to ensure sufficient row to row isolation in the presence of applied column voltages.

If a data pulse is provided, at time t0 in FIG. 6 a weak discharge forms between the back plate address electrode and the active scan electrode, and at time t1, a negative resistance plasma discharge forms. At time t2, the availability of positive charge on the sustain electrodes allows the positive column to rapidly engulf the sustain electrode, and at time t3 can easily spread across the inter-pixel gap to the neighboring sustain electrode and thereby deplete the positive charge of the neighboring pixel P2. When P2's scan electrode is selected and the column electrode is driven, the weak back to front discharge may form, however, without the positive charge on the sustain electrode, the plasma will not form, the scan electrode will maintain its negative charge, and pixel P2 will remain off.

In a paper entitled "Symmetrically driven PDP, with minimized current loops to reduce EMI" by Vossen et al. (hereinafter "the Vossen et al. paper"), there is disclosed the usage of interlaced addressing to reduce crosstalk in a PDP. With interlaced addressing, the odd rows are addressed followed by the even rows. As such, any gas priming resulting from addressing the odd rows will be fully extinguished prior to addressing the even rows. The Vossen et al. paper also talks of a symmetrically sustained PDP that uses the paired electrode configuration described in the Marcotte '214 patent as helping to reduce vertical crosstalk. However, the Vossen et al. paper does not describe or correct for the form of vertical crosstalk described herein. Specifically, the Vossen et al. paper describes addressing with the electrodes configured as non-paired electrodes (i.e., scan, sustain, scan, sustain), which does not have a common potential across an inter-pixel gap during addressing. In the non-paired case, a crosstalk discharge will in fact go in the wrong direction, discharging to an incorrect sustain electrode. The use of interlaced addressing reduces this likelihood of this artifact.

SUMMARY OF THE INVENTION

The present invention minimizes crosstalk discharge probability between pixels in a plasma display panel while retaining benefits of a paired electrode configuration. Also, an inter-pixel gap may be reduced to enlarge the pixel size to increase brightness, and the pixel density may be increased to realize a higher resolution display.

The present invention reduces probability of address discharge crosstalk in a paired electrode configuration by reducing voltage on an inactive sustain electrode during addressing. By reducing voltage on the inactive sustain electrode, a positive column formed in an address discharge will not spread across the inter-pixel gap. The sustain electrodes are separated into odd and even row associations. Operation of the setup and sustain cycles is unchanged. During addressing, the odd rows are addressed while the voltage on the even sustain electrodes is reduced. Once addressing of the odd rows is complete, the voltage on the even sustain electrodes is returned high, the voltage on the odd sustain electrodes is reduced, and the even rows are addressed.

In some embodiments of the present invention, the voltage on the inactive sustain electrodes is reduced only during the first half of addressing. In this case, crosstalk will continue to occur during the second half of addressing. However, this is acceptable since the crosstalk results in the inactive cell always being OFF during the sustain period.

The present invention may be applied to any paired electrode configuration independent of setup or sustain waveform variations, provided that the sustain electrodes are high while the scan electrodes are low during addressing, thus allowing for a discharge to form at the scan electrode, which then spreads to the sustain electrode, neutralizing the voltage therebetween.

The present invention a method for controlling sustain electrodes in a PDP. The method includes enabling a first sustain electrode to produce an addressing discharge, and disabling a second sustain electrode when the first sustain electrode is producing the addressing discharge. The first sustain electrode is adjacent to the second sustain electrode.

One embodiment of the invention is a circuit for controlling sustain electrodes in a PDP. The circuit includes an output for enabling a first sustain electrode to produce an addressing discharge, and an output for disabling a second sustain electrode when the first sustain electrode is producing the addressing discharge. The first sustain electrode is adjacent to the second sustain electrode.

Another embodiment of the present invention is a system that has a PDP having a first sustain electrode and a second sustain electrode adjacent to the first sustain electrode, and a circuit for (a) enabling the first sustain electrode to produce an addressing discharge, and (b) disabling the second sustain electrode when the first sustain electrode is producing the addressing discharge.

DESCRIPTION OF THE INVENTION

Figure 7:
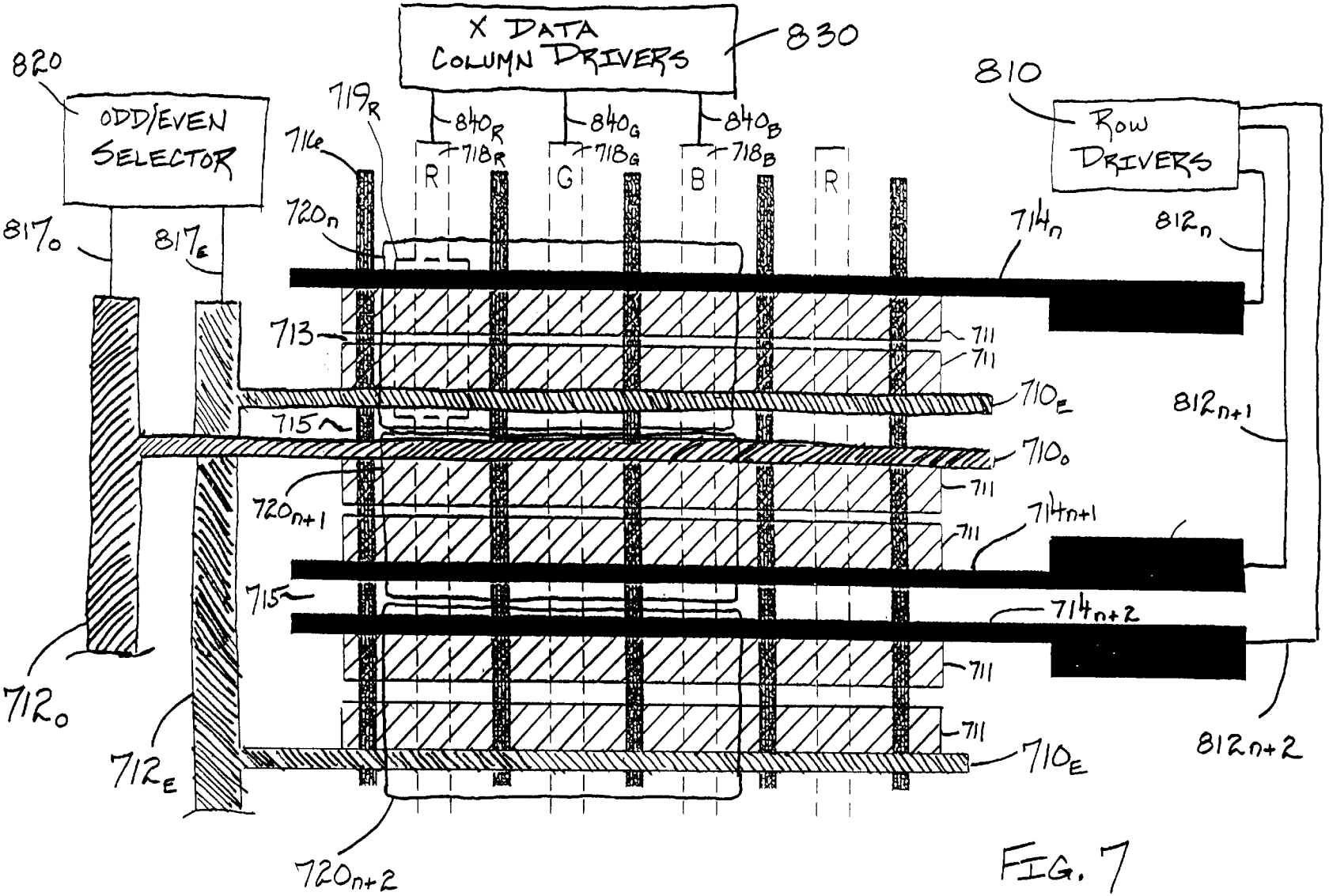
FIG. 7 is a schematic representation of a color PDP in accordance with the present invention.

FIG. 7 is a schematic representation of a portion of a color PDP in accordance with the present invention. The PDP is organized into rows of pixels, three of which are shown, namely, a pixel $\mathbf{720}_n$ in row "n", a pixel $\mathbf{720}_{n+1}$ in row "n+1", and a pixel $\mathbf{720}_{n+2}$ in row "n+2". The rows are regarded as "odd" and "even" in an alternating pattern, where for example, row "n" is designated as an even row and row "n+1" is designated as an odd row.

The portion of the PDP shown in FIG. 7 includes an even sustain bus $\mathbf{712}_E$ connected to a bank of even sustain electrodes $\mathbf{710}_E$, an odd sustain bus $\mathbf{712}_O$ connected to a bank of odd scan electrodes $\mathbf{710}_O$, scan electrodes $\mathbf{714}_n$, $\mathbf{714}_{n+1}$ and $\mathbf{714}_{n+2}$, and column electrodes $\mathbf{718}_R$, $\mathbf{718}_G$ and $\mathbf{718}_B$ (for red, green, and blue, respectively). Each even sustain electrode $\mathbf{710}_E$ is adjacent to an odd sustain electrode $\mathbf{710}_O$. For example, even sustain electrode $\mathbf{710}_E$ in row "n" is adjacent to odd sustain electrode $\mathbf{710}_O$ in row "n+1". There is also a transparent electrode 711 associated with each of sustain electrodes $\mathbf{710}_E$ and $\mathbf{710}_O$, and scan electrodes $\mathbf{714}_n$, $\mathbf{714}_{n+1}$ and $\mathbf{714}_{n+2}$.

An intersection of a sustain electrode, a scan electrode and a column electrode, defines a subpixel. For example, a subpixel $\mathbf{719}_R$ is defined for the intersection of sustain electrode $\mathbf{710}_E$, scan electrode $\mathbf{714}_n$, and column electrode $\mathbf{718}_R$. Barrier ribs 716 separate subpixels from one another. Each pixel is defined as a region of intersection of a sustain electrode, a scan electrode, and three column electrodes. For example, pixel $\mathbf{720}_n$ is defined at the region of intersection of sustain electrode $\mathbf{710}_E$, scan electrode $\mathbf{714}_n$, and column electrodes $\mathbf{718}_R$, $\mathbf{718}_G$ and $\mathbf{718}_B$. An inter-pixel gap 715 is defined for a region between adjacent pixels.

Each pixel includes a discharge gap where a sustain discharge forms. For example, in pixel $\mathbf{720}_n$, a discharge gap 713 is located between (a) a transparent electrode 711 associated with scan electrode $\mathbf{714}_n$ and (b) a transparent electrode associated with even sustain electrode $\mathbf{710}_E$.

An even/odd selector 820 drives odd sustain bus $\mathbf{712}_O$ via an odd sustain driver line $\mathbf{817}_O$, and drives even sustain bus $\mathbf{712}_E$ via an even sustain driver line $\mathbf{817}_E$. Column driver 830 drives column electrodes $\mathbf{718}_R$, $\mathbf{718}_G$ and $\mathbf{718}_B$ via column driver lines $\mathbf{840}_R$, $\mathbf{840}_G$ and $\mathbf{840}_B$, respectively. Row drivers 810 drive scan electrodes $\mathbf{714}_n$, $\mathbf{714}_{n+1}$, and $\mathbf{714}_{n+2}$ via row driver lines $\mathbf{812}_n$, $\mathbf{812}_{n+1}$, and $\mathbf{812}_{n+2}$. The operation of even/odd selector 820, column driver 830 and row drivers 810 are further described in association with FIG. 8.

As mentioned earlier, FIG. 7 shows only a portion of the PDP. In practice, the PDP will include a plurality of rows and columns. Accordingly, column drivers 830 will drive many more columns than are shown in FIG. 7, and row drivers 810 will drive many more rows than are shown in FIG. 7.

Figure 8:
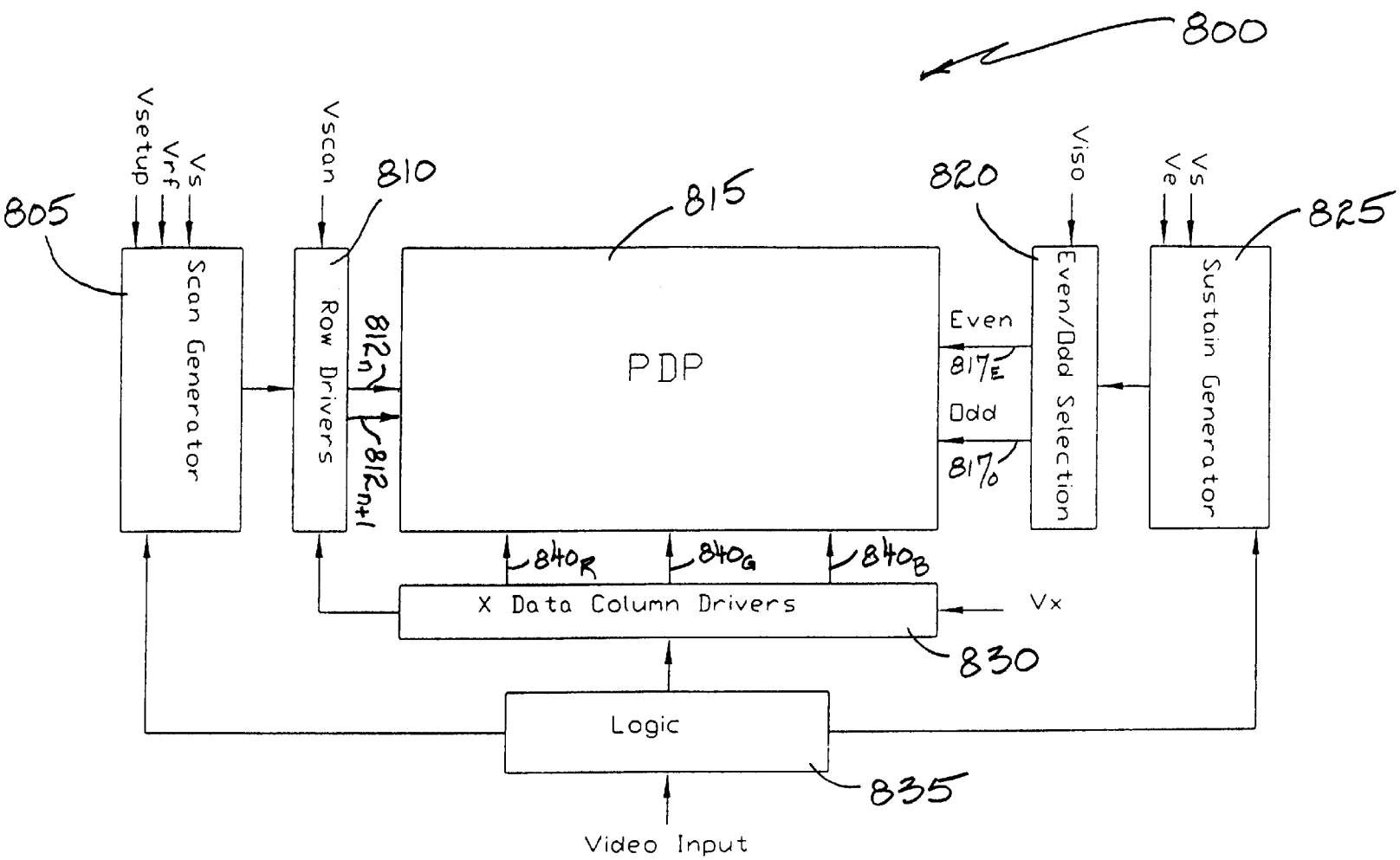
FIG. 8 is a block diagram of a PDP system in accordance with the present invention.

FIG. 8 is a block diagram of a PDP system 800 configured in accordance with the present invention. The principal components of system 800 include a scan generator 805, row drivers 810, a PDP 815, even/odd selector 820, a sustain generator 825, column drivers 830 and logic 835.

Figure 1:
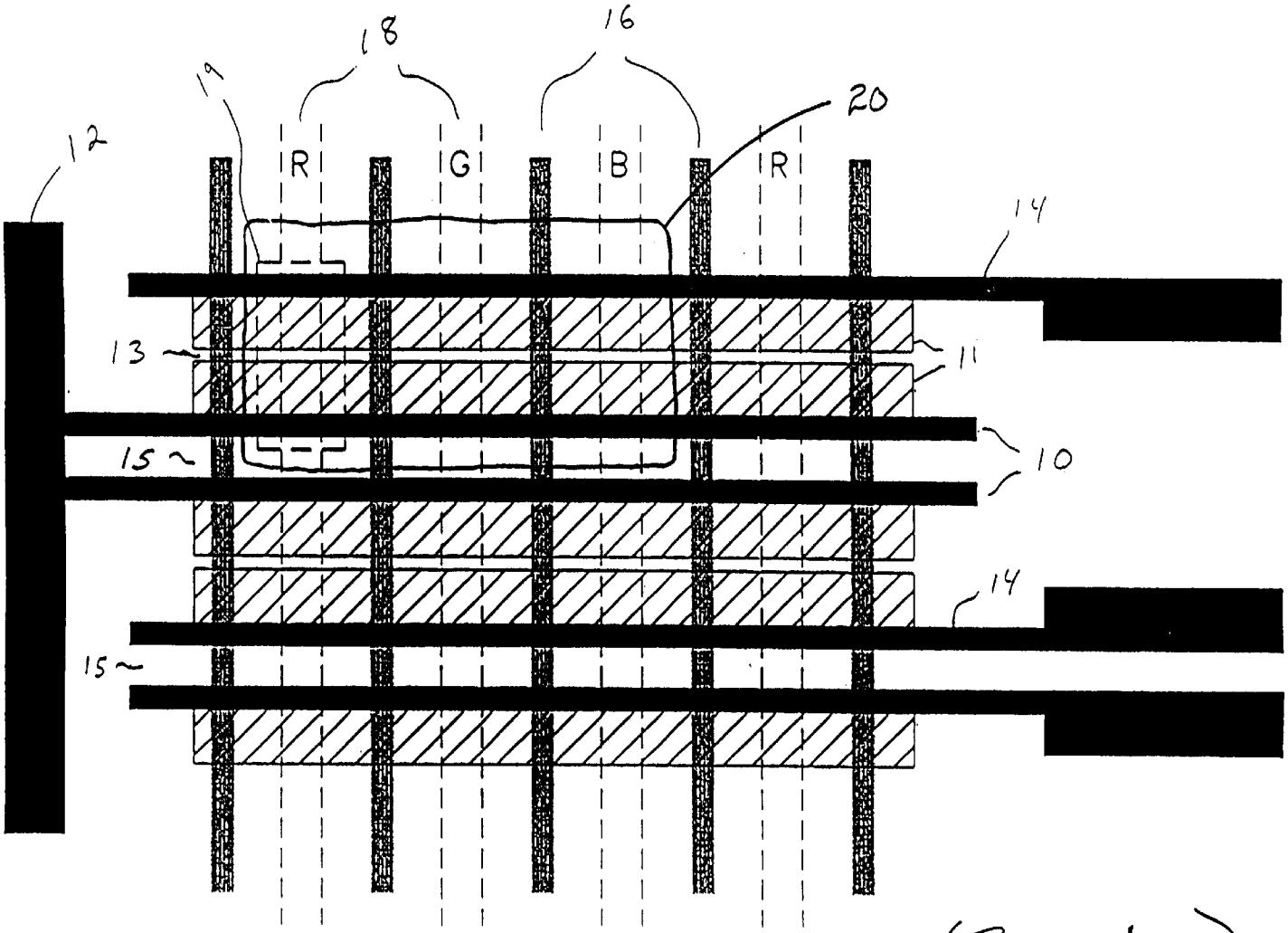
(PRIOR ART) FIG. 1
FIG. 1 is a schematic representation of a conventional color PDP.
Figure 2:
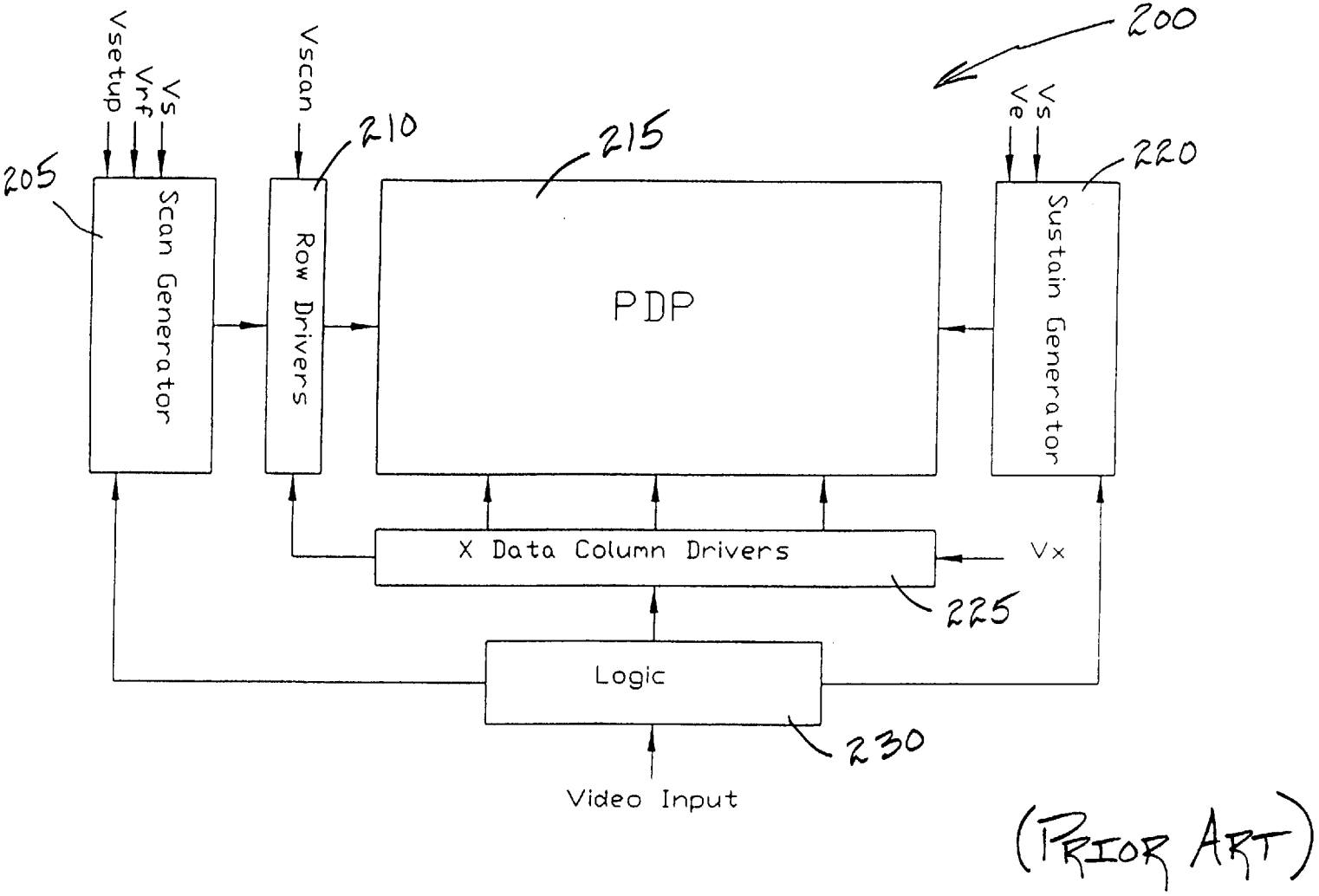
(PRIOR ART) FIG. 2
FIG. 2 is a block diagram of a conventional PDP system.
Figure 3:
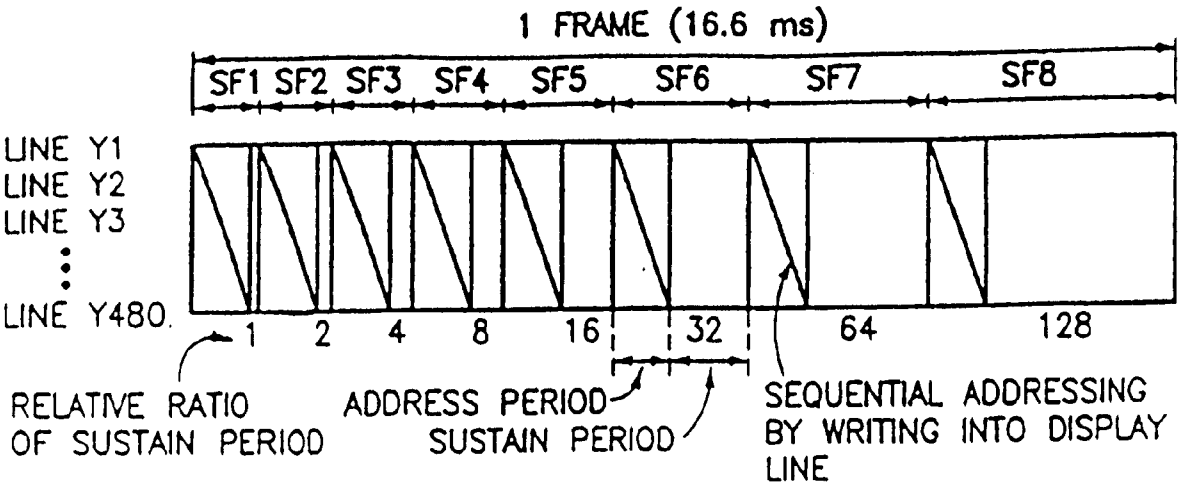
(PRIOR ART) FIG. 3
FIG. 3 is graph showing the division of frame time into 8 subfields.
Figure 4:
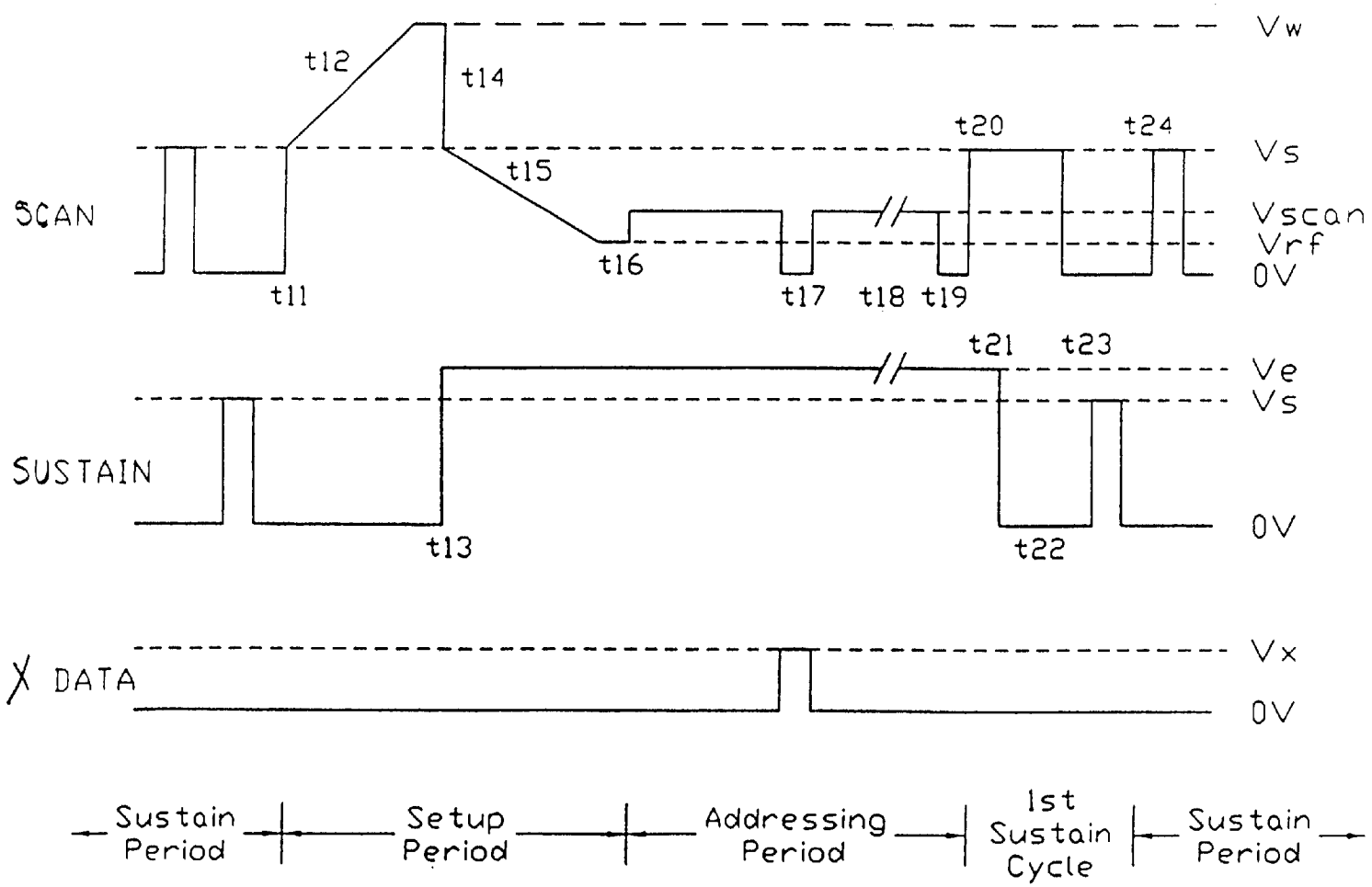
FIG. 4 (PRIOR ART)
FIG. 4 is a graph of conventional subfield waveforms.
Figure 5:
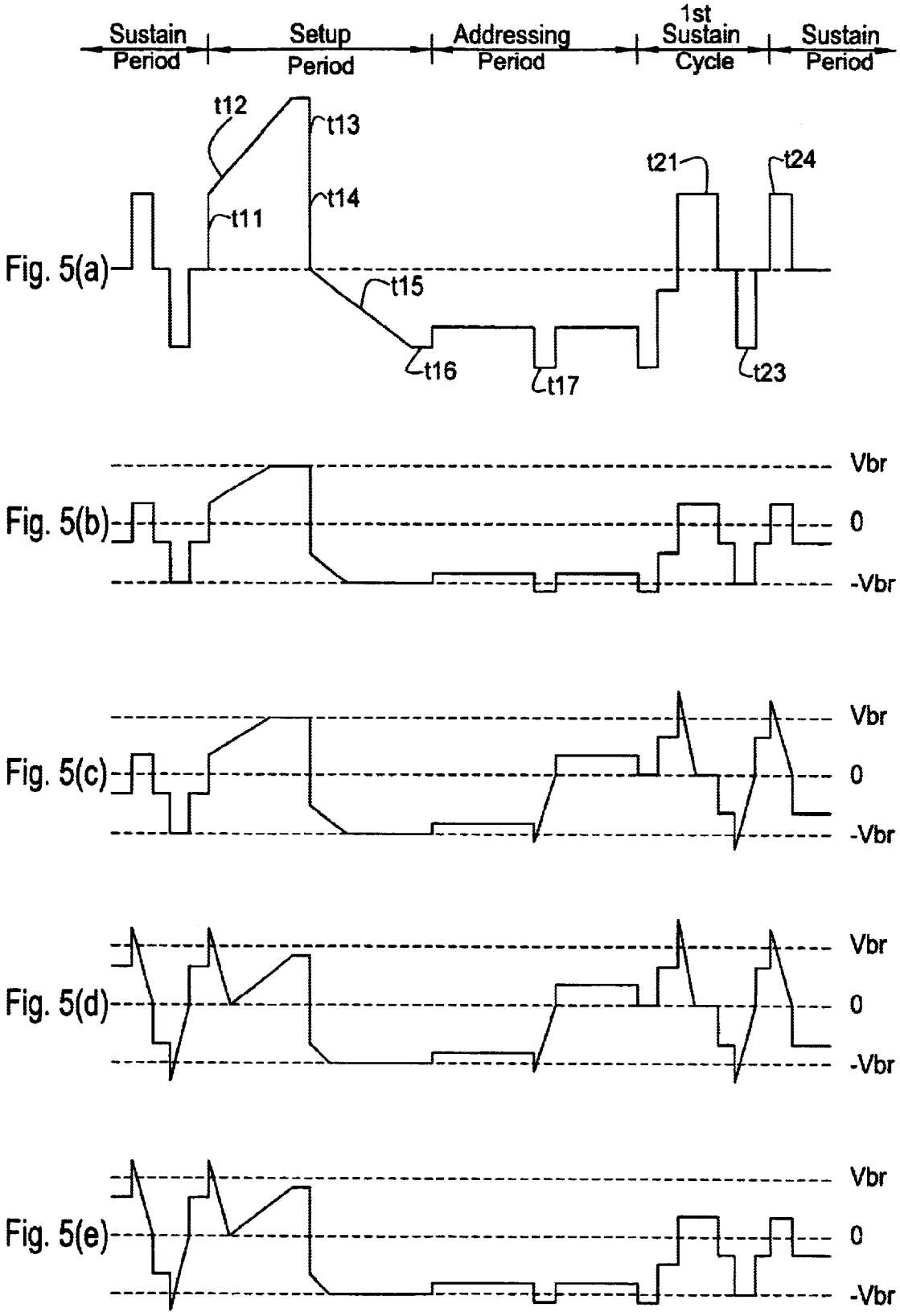
FIG. 5*a* is a graph of a conventional composite waveform between a scan electrode and a sustain electrode.
FIGS. 5*b*–5*e* are graphs of conventional wall voltage waveforms for pixel addressing sequences.
Figure 6:
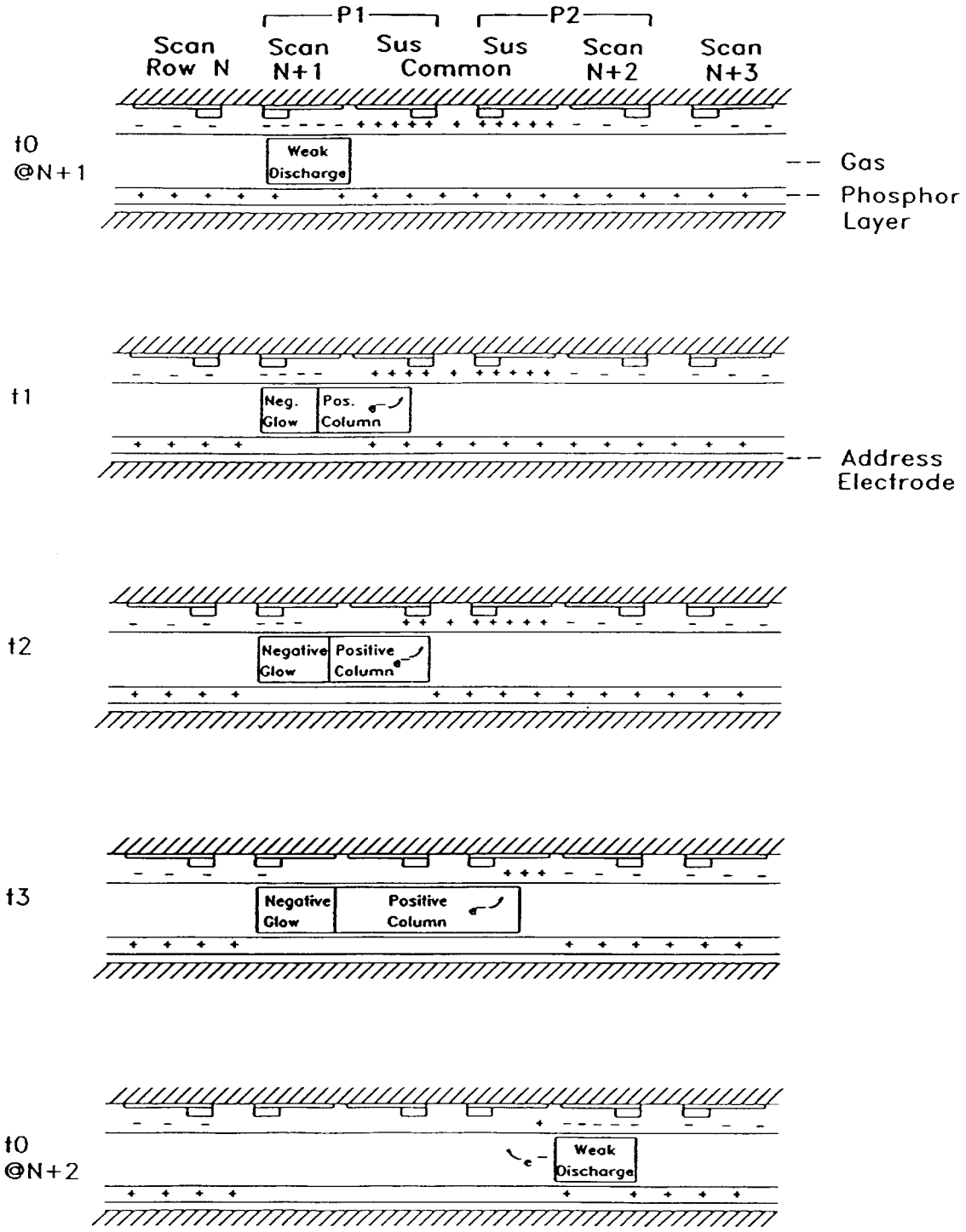
FIG. 6 (PRIOR ART)
FIG. 6 is a schematic representation of discharge mechanics for an address discharge showing crosstalk discharge for the PDP of FIG. 1.

Sustain generator 825 operates in the same manner as sustain generator 220 (FIG. 2), but supplies voltage Ve to even/odd selector 820 during addressing.

Even/odd selector 820 is a circuit that employs method for controlling sustain electrodes in a PDP in accordance with the present invention. The method includes (a) enabling a first sustain electrode to produce an addressing discharge, and (b) disabling a second sustain electrode when the first sustain electrode is producing the addressing discharge, where the first sustain electrode is adjacent to the second sustain electrode.

Even/odd selector 820 controls even sustain electrodes $\mathbf{710}_E$ and odd sustain electrodes $\mathbf{710}_O$. It supplies an isolation voltage (Viso) to even sustain electrodes $\mathbf{710}_E$ via an output to sustain driver line $\mathbf{817}_E$, and supplies Viso to odd sustain electrodes $\mathbf{710}_O$ via an output to sustain driver line $\mathbf{817}_O$. The purpose of Viso is further explained below.

Figure 9:
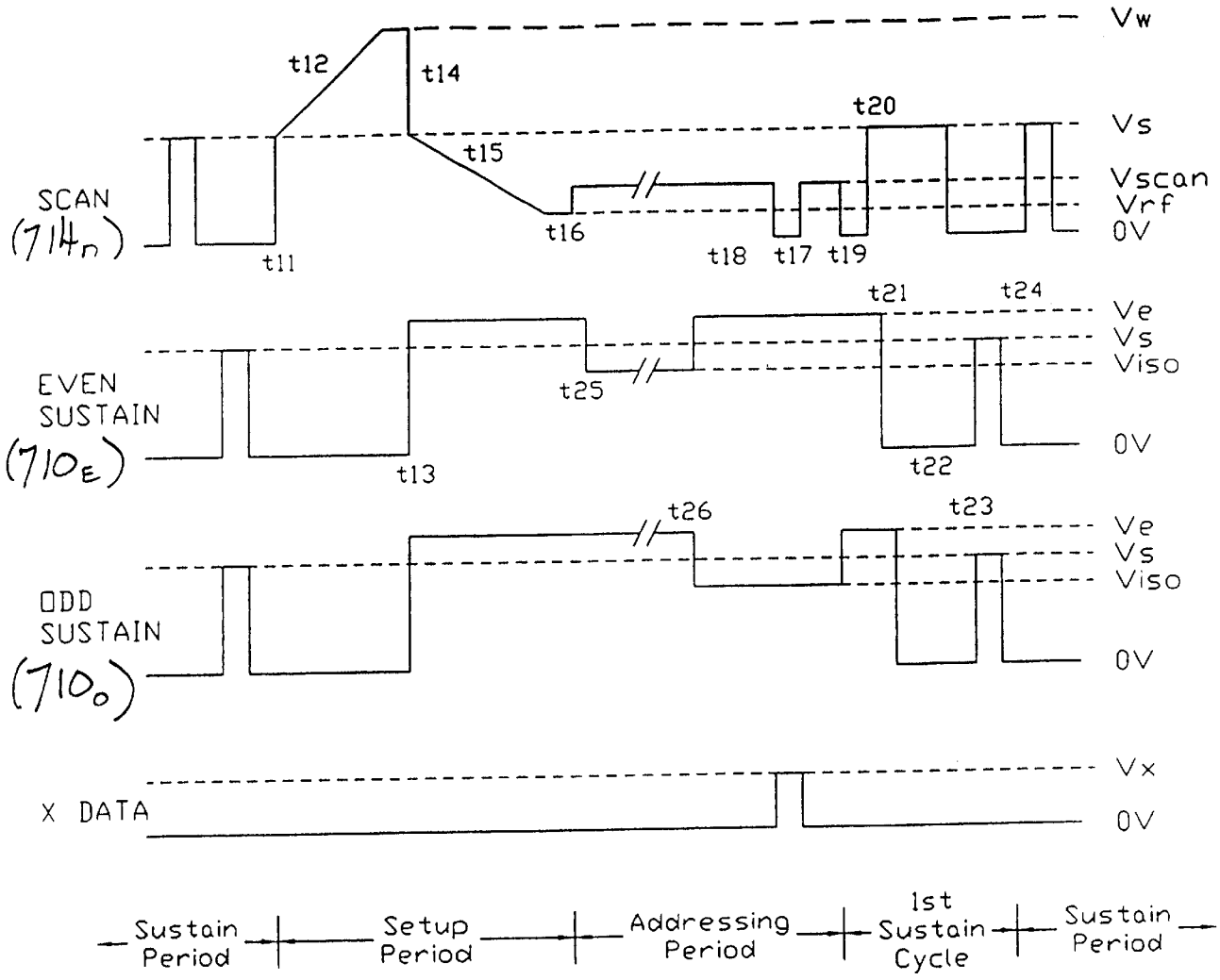
FIG. 9 is a graph of even and odd sustain electrode waveforms for a PDP according to the present invention.

FIG. 9 is a graph of even and odd sustain electrode waveforms during an addressing of an even row at time t17 (odd rows are isolated at t17). Assume that the waveforms are for scan electrode $\mathbf{714}_n$, even sustain electrode $\mathbf{710}_E$ and odd sustain electrode $\mathbf{710}_O$. The X Data waveform represents an output of column driver 830 to one of column driver lines $\mathbf{840}_R$, $\mathbf{840}_G$ and $\mathbf{840}_B$. Typical operating voltages for the PDP of FIG. 7 operated with the waveforms of FIG. 9 would be a setup voltage Vw of 400V, a sustain voltage Vs of 180V, a Vscan voltage of 120V, a ramp bias voltage Vrf of 10V, a setup/erase voltage Ve of 220V, an isolation voltage Viso of 0 to 120V (Viso is typically at least 60 volts below voltage Ve), and a data voltage Vx of 65V.

The voltage on even sustain electrode $\mathbf{710}_E$ is referenced to a voltage on scan electrode $\mathbf{714}_n$. The voltage on odd sustain electrode $\mathbf{710}_O$ is referenced to a voltage on scan electrode $\mathbf{714}_{n+1}$. These references are established during the setup period. During the setup period, even/odd selector 820 provides Ve to, and thus enables, both even sustain electrode $\mathbf{710}_E$ and odd sustain electrode $\mathbf{710}_O$.

At t25, the addressing period begins, and even/odd selector 820 reduces the voltage supplied to even sustain electrode $\mathbf{710}_E$ to Viso thus reducing the difference of voltage, and therefore the magnitude, between even sustain electrode $\mathbf{710}_E$ and scan electrode $\mathbf{714}_n$. This disables the even bank for the first half of the addressing period. Note that during the first half of the addressing period, odd sustain electrode $\mathbf{710}_O$ is enabled. At time t26, even/odd selector 820 restates the voltage on even sustain electrode $\mathbf{710}_E$ to Ve, and reduces the voltage on odd sustain electrode $\mathbf{710}_O$ to Viso, thus reducing the magnitude of the difference in voltage between odd sustain electrode $\mathbf{710}_O$ and scan electrode $\mathbf{714}_{n+1}$. Thus, at time t26 the even and odd banks switch roles for the second half of the addressing period so that the odd bank is disabled and the even bank is enabled. At time t17, during the second half of the addressing period, even sustain electrode $\mathbf{710}_E$ produces an addressing discharge to scan electrode $\mathbf{714}_n$. Crosstalk between even sustain electrode $\mathbf{710}_E$ and odd sustain electrode $\mathbf{710}_O$ is minimized by the lower potential (i.e., Viso) on odd sustain electrode $\mathbf{710}_O$ at time t17. This is because the enabling voltage Ve on even sustain electrode $\mathbf{710}_E$ is referenced to the voltage on scan electrode $\mathbf{714}_n$, and the disabling voltage Viso on odd sustain electrode $\mathbf{710}_O$, when referenced to the voltage on scan electrode $\mathbf{714}_n$ is a lower magnitude than the enabling voltage Ve. Similarly, the row select and the respective column data are synchronized by logic block 835 to sequence through the odd rows first followed by the even rows.

In FIG. 9, a negative pulse on scan electrode $\mathbf{714}_n$ during the addressing period indicates the time at which a particular pixel is addressed. Such a pulse occurs at time t17. Note that also at time t17 even sustain electrode $\mathbf{710}_E$ is at Ve (and therefore enabled) while odd sustain electrode $\mathbf{710}_O$ is at Viso (and therefore disabled). Accordingly, the waveforms in FIG. 9 are for a case of addressing an even row in PDP 815, and more particularly, row "n".

In the first sustain cycle, at time t20 there is a rising edge for the voltage on scan electrode $\mathbf{714}_n$, and at t21 there is a falling edge for the voltage on even sustain electrode $\mathbf{710}_E$. The addressing discharge that was produced by even sustain electrode $\mathbf{710}_E$ at time t17 allows even sustain electrode $\mathbf{710}_E$ to produce a first sustain discharge during time t22.

Figure 10A:
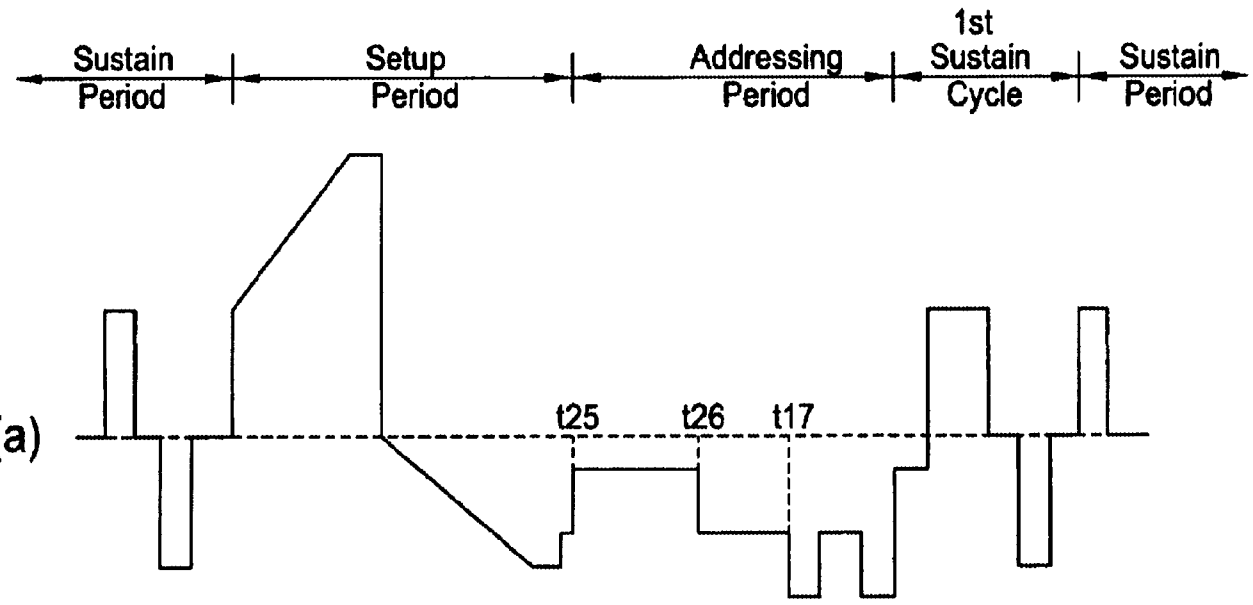
FIG. 10*a* is a graph of a composite waveform.
Figure 10B:
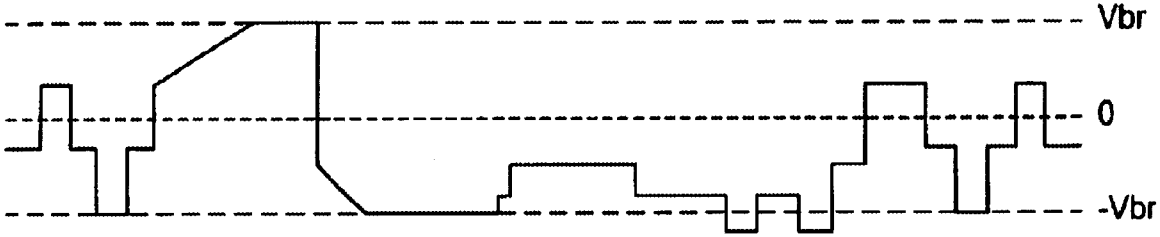
FIG. 10*b* is a graph of a wall voltage waveform, for an even bank of electrodes according to the present invention.

FIG. 10*a* is a graph of a composite waveform of the scan waveform and even sustain waveform of FIG. 9, and FIG. 10*b* is a graph of a wall voltage waveform, for an OFF sub-pixel on the even bank of electrodes according to the present invention. Since the graph is that of an off sub-pixel, the breakdown voltage is only exceeded during the two setup ramps where the wall voltage is limited to Vbr and −Vbr, approximately ±200V.

The composite waveform is formed by subtracting the sustain electrode voltage from the scan electrode voltage. Assume for example, a case of even sustain electrode $\mathbf{710}_E$ and scan electrode $\mathbf{714}_n$. Reducing voltage on even sustain electrode $\mathbf{710}_E$ from Ve to Viso at t25 for the first half of the addressing period causes an increase in the composite voltage and thereby reduces the voltage across the gas. When the voltage on even sustain electrode $\mathbf{710}_E$ is increased from Viso to Ve during the second half of the addressing period, the wall voltage returns close to the breakdown voltage −Vbr, so that the application of the row select pulse at t17 slightly exceeds the breakdown voltage −Vbr.

Figure 11:
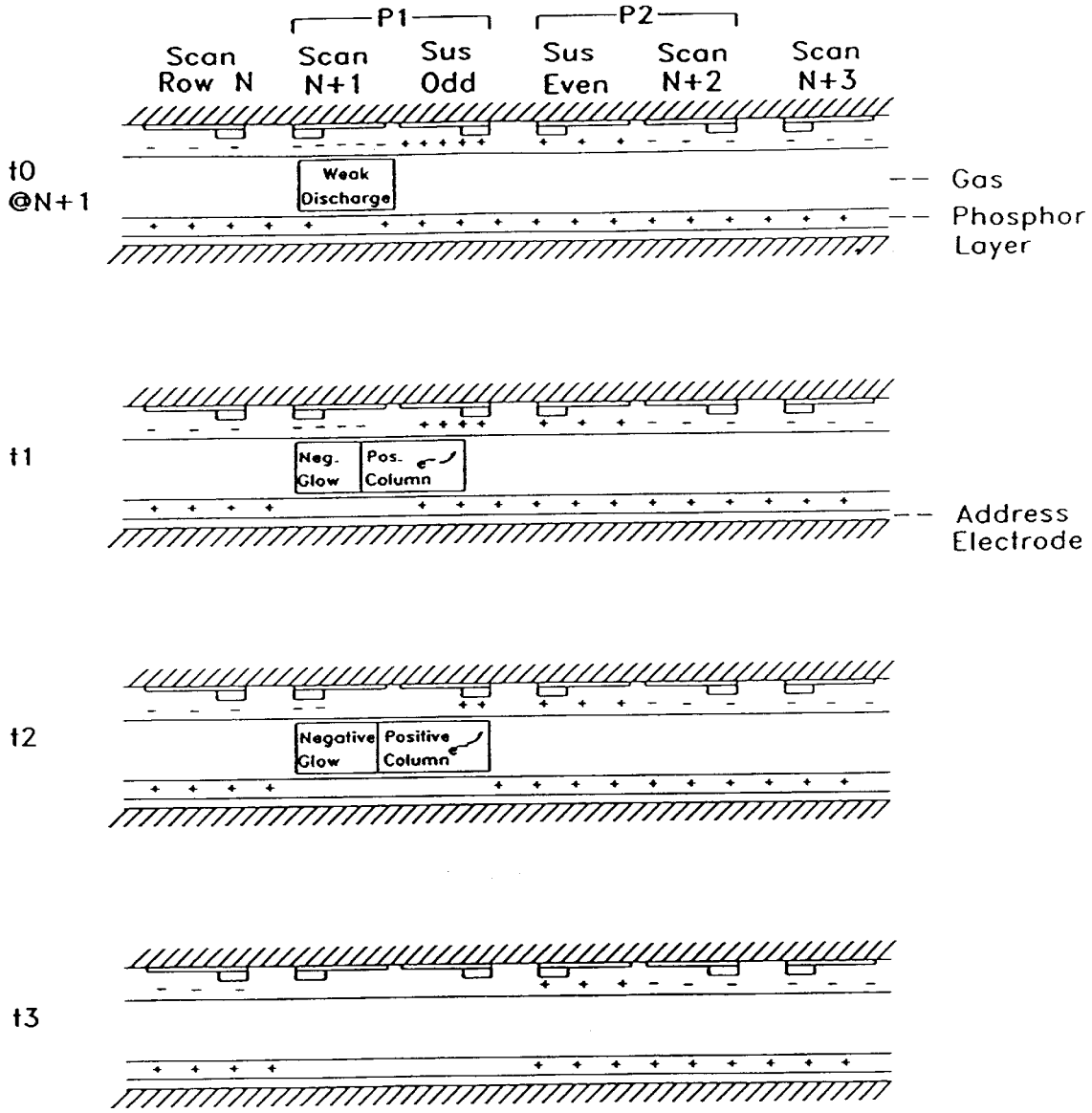
FIG. 11 is a schematic representation of a cross-sectional view of the odd pixel discharge mechanics according to the present invention.
Figure 12:
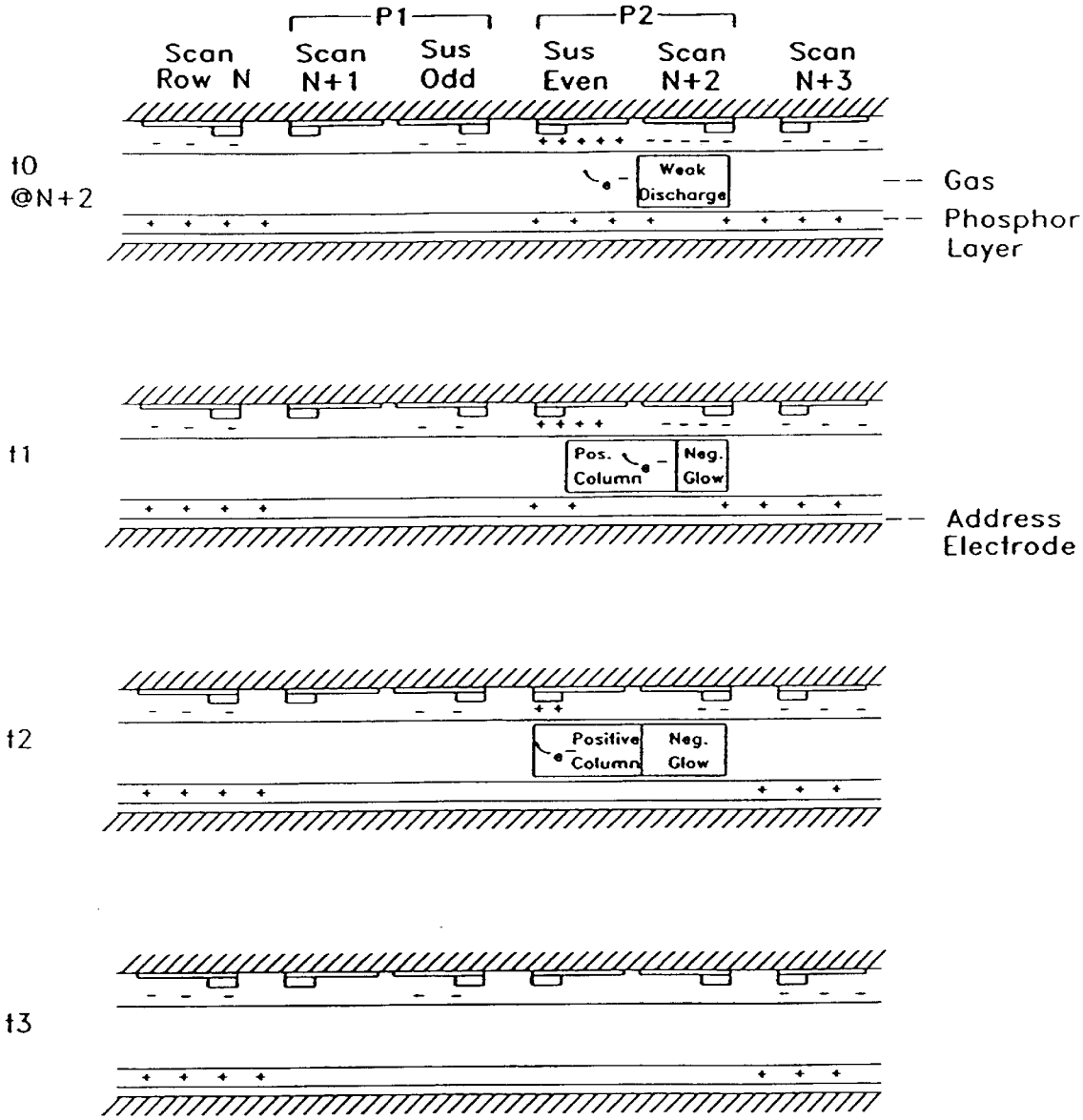
FIG. 12 is a schematic representation of a cross-sectional view of the even pixel discharge mechanics according to the present invention.

FIGS. 11 and 12 show cross sectional views of pixel addressing discharge mechanics. More particularly, FIG. 11 shows the addressing discharge mechanics for an odd pixel P1, and FIG. 12 shows a neighboring even pixel P2. In FIG. 11, P1's sustain electrode is tied to the enabled odd sustain bank, and thus has more positive charge than the disabled even sustain electrode. The P1 address discharge is initiated via an applied data pulse, however, the reduced positive charge on the even sustain electrode reduces the tendency of the positive column to spread into the P2 pixel space. The lower the Viso voltage applied to the even electrode, the greater the isolation achieved.

The address discharge on P1 neutralizes the voltage across the pixel site therefore, disabling the odd bank for the second half of addressing will result in a minor negative charge on the odd sustain electrode due to the drop in voltage. Since the voltage change is minor compared to the gas breakdown voltage, this effect is irrelevant. Enabling the even sustain electrodes returns them to their full positive charge so that when P2 is selected and a discharge forms, there is sufficient positive charge on P2's sustain electrode available to form a plasma to neutralize the scan electrode's negative charge.

Figure 13:
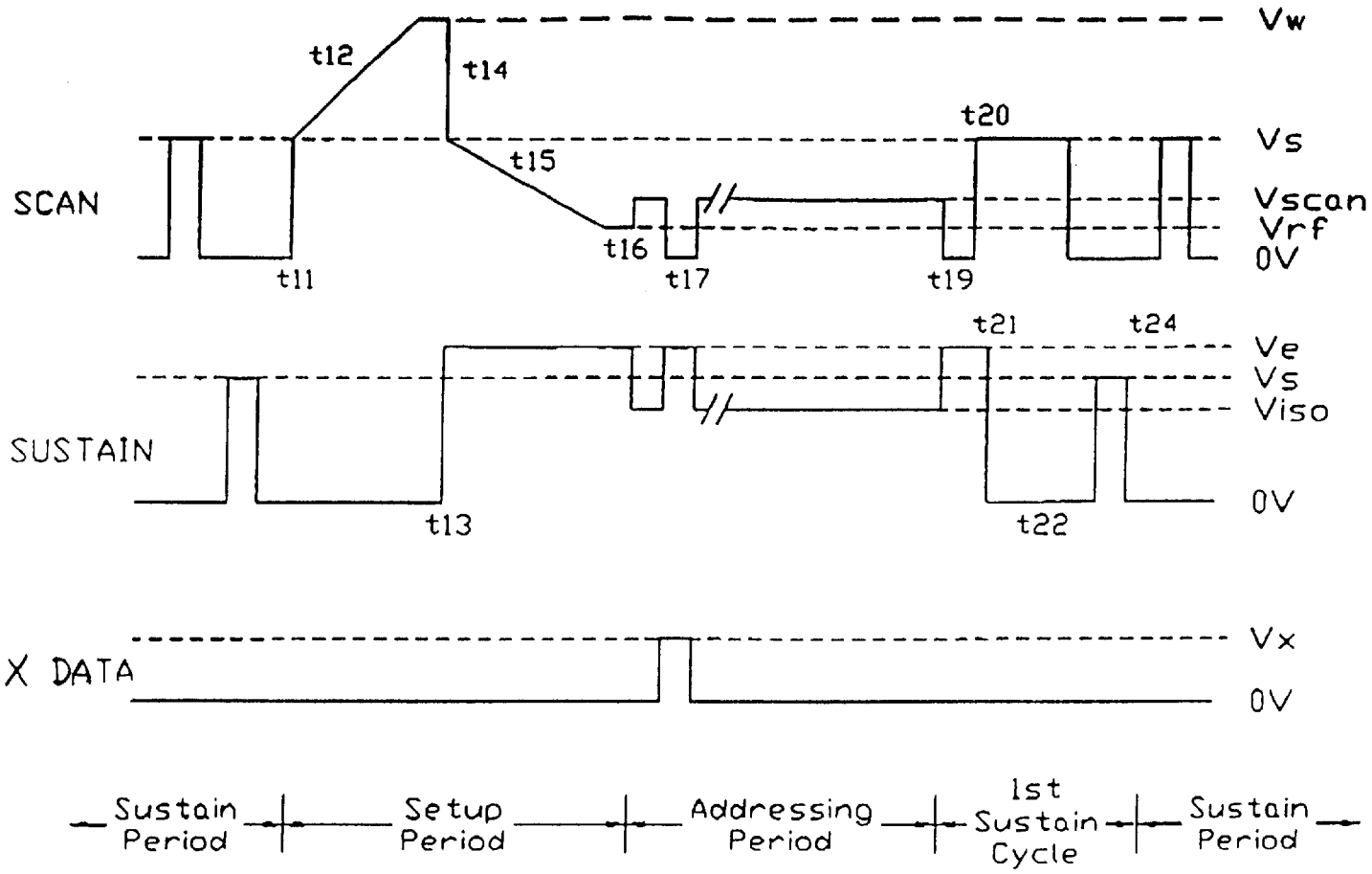
FIG. 13 is a graph of an embodiment of the invention utilizing sequential addressing wherein sustain electrodes are enabled in conjunction with their corresponding scan electrodes.

FIG. 13 is a graph of scan and sustain electrode waveforms for a PDP in a variation of the invention where the voltage on the sustain electrodes is reduced to Viso to provide cell-to-cell isolation. As each row is sequentially selected on the scan side by a negative row select pulse at t17, a corresponding sustain electrode is returned to the sustain side addressing voltage Ve, thus providing a positive row select on the sustain side. Such an embodiment may be realized through the use of row drivers on the sustain side in place of even/odd selector 820 of FIG. 7.

Figure 14:
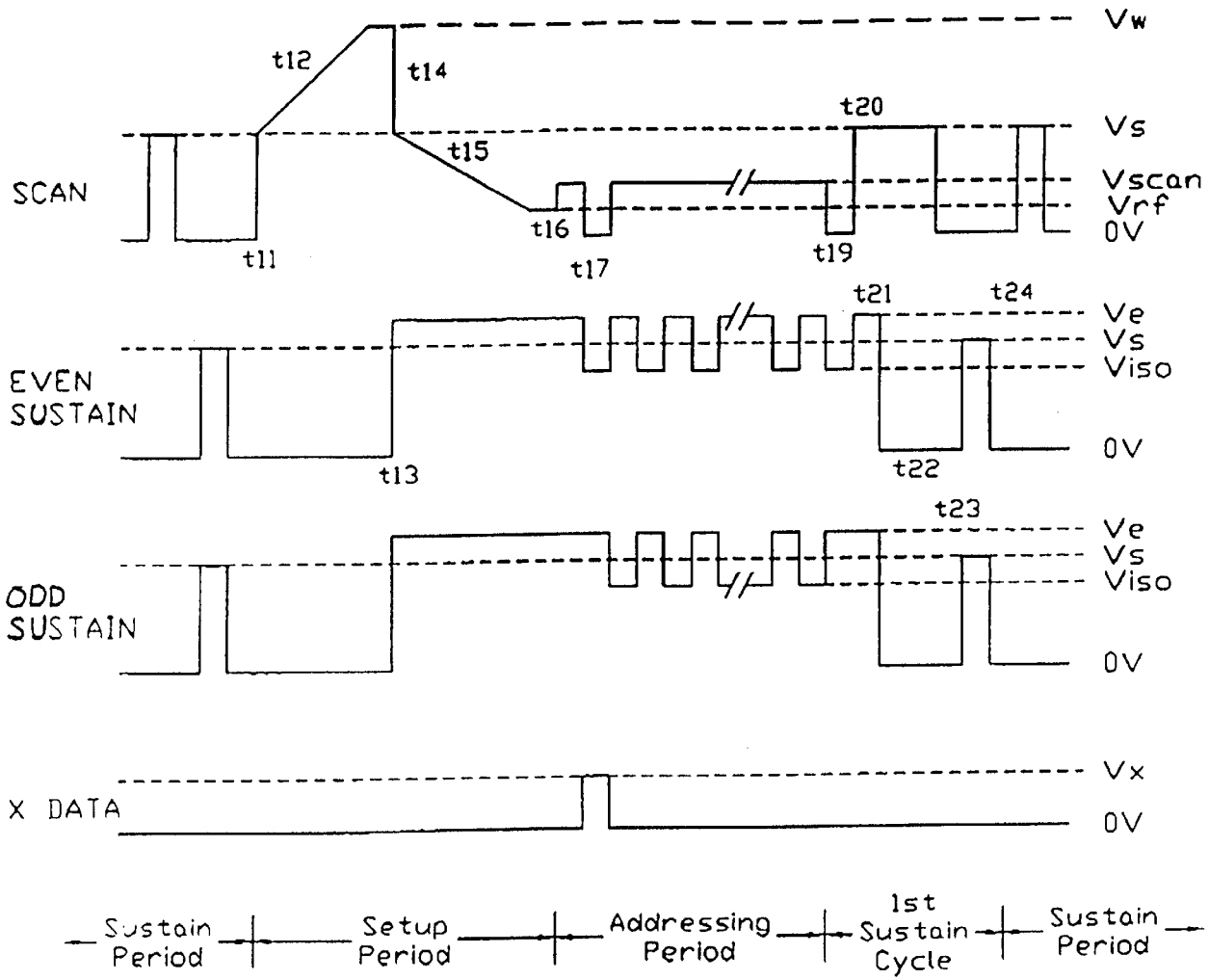
FIG. 14 is a graph of even and odd sustain electrode waveforms for a PDP, where the sustain electrodes are separated into odd and even sustain buses.

FIG. 14 is a graph of even and odd sustain electrode waveforms for a PDP in another variation of the invention where the sustain electrodes are separated into odd and even sustain buses. Row drivers 810 provide sequential negative going row select pulses during the addressing period, while the sustain electrode voltage alternates between Viso and Ve as the row select pulse is applied to each scan electrode. In FIG. 14, at time t17 there is a selection of an odd row, as the even sustain electrodes are driven to the isolation voltage Viso, while the odd sustain electrodes are driven to the sustain side addressing voltage Ve.

Figure 15:
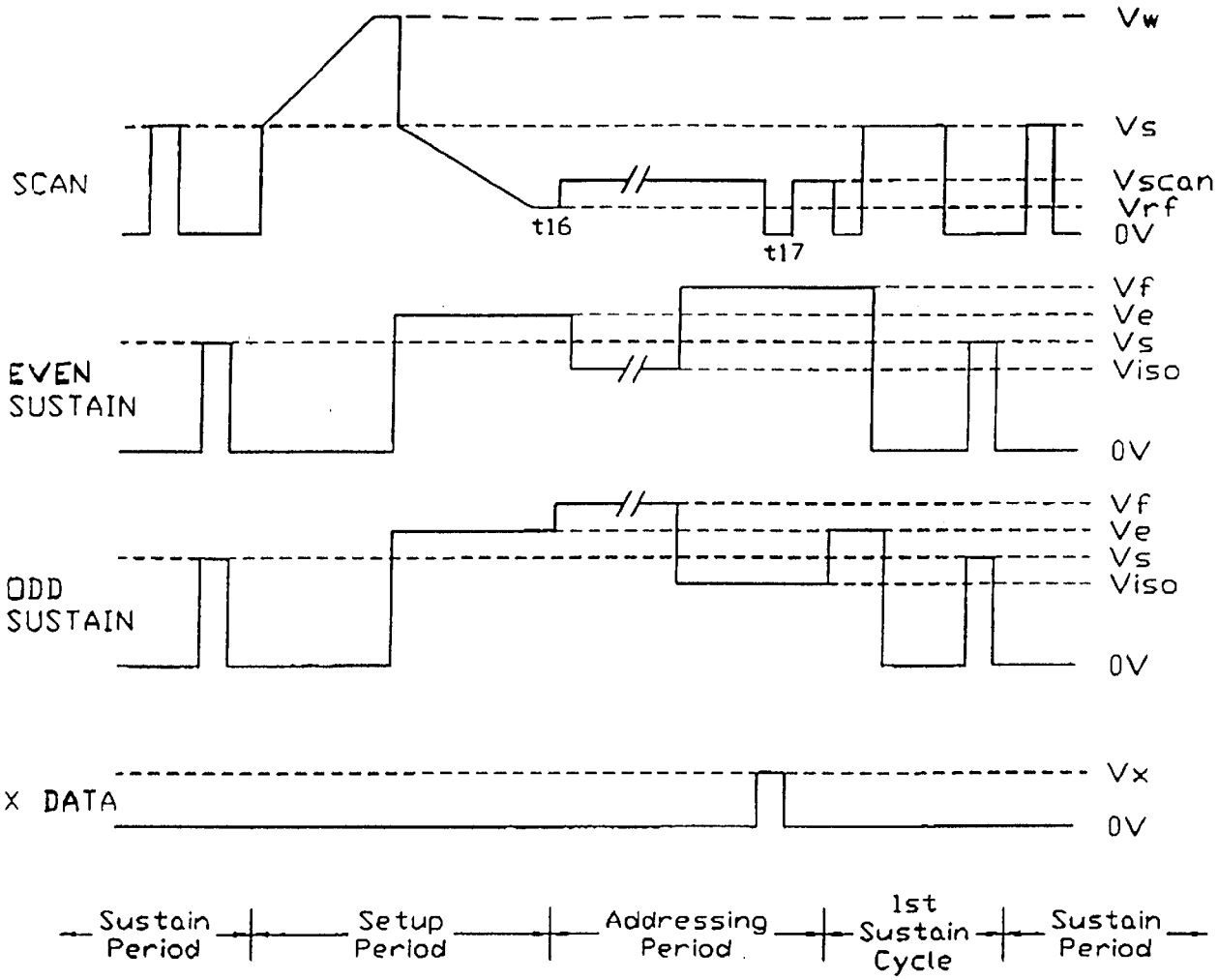
FIG. 15 is a graph of even and odd sustain electrode waveforms for a PDP, where an increased voltage Vf is applied to the odd or even sustain electrode buses.

FIG. 15 is a graph of even and odd sustain electrode waveforms for a PDP, where an increased forward voltage Vf of typically 10V higher than voltage Ve is applied to the odd or even sustain electrode buses. This arrangement provides additional voltage across the pixel to improve the panel's addressing margin by increasing the charge transfer of the address discharge. Utilization of forward voltage Vf may also be applied to the waveforms of FIGS. 13 and 14.

It should be understood that the foregoing description is only illustrative of the invention. Various alternatives and modifications can be devised by those skilled in the art without departing from the invention. For instance, this invention is applicable other AC PDP and waveform configurations, where an address discharge extends across a pixel and can spread across an inter-pixel gap, seeking positive charge on an adjacent sustain electrode. The present invention is intended to embrace all such alternatives, modifications and variances that fall within the scope of the appended claims.

What is claimed is:

1. A method for controlling sustain electrodes in a plasma display panel (PDP), comprising:

enabling a first sustain electrode to produce an addressing discharge; and disabling a second sustain electrode when said first sustain electrode is producing said addressing discharge, wherein said first sustain electrode is adjacent to said second sustain electrode.

2. The method of claim 1, wherein said first sustain electrode is in a first row of said PDP, and said second sustain electrode is in a second row of said PDP.

3. The method of claim 1, wherein said enabling allows said first electrode to produce a sustain discharge during a sustain period, and wherein said disabling prevents said second sustain electrode from producing a sustain discharge during said sustain period.

4. The method of claim 1, wherein said enabling provides an enabling voltage to said first sustain electrode, and wherein said disabling provides a disabling voltage to said second sustain electrode.

5. The method of claim 4, wherein said enabling voltage is referenced to a scan electrode voltage, and wherein said disabling voltage, when referenced to said scan electrode voltage, is a lower magnitude than said enabling voltage.

6. The method of claim 1, wherein said first sustain electrode is addressed during a first portion of an addressing period, and wherein said second sustain electrode is addressed during a second portion of said addressing period.

7. The method of claim 6, wherein said first portion of said addressing period is a first half of said addressing period, and wherein said second portion of said addressing period is a second half of said addressing period.

8. A circuit for controlling sustain electrodes in a plasma display panel (PDP), comprising:

an output for enabling a first sustain electrode to produce an addressing discharge; and an output for disabling a second sustain electrode when said first sustain electrode is producing said addressing discharge, wherein said first sustain electrode is adjacent to said second sustain electrode.

9. The circuit of claim 8, wherein said first sustain electrode is in a first row of said PDP, and said second sustain electrode is in a second row of said PDP.

10. The circuit of claim 8, wherein said output for enabling allows said first electrode to produce a sustain discharge during a sustain period, and wherein said output for disabling prevents said second sustain electrode from producing a sustain discharge during said sustain period.

11. The circuit of claim 8, wherein said output for enabling provides an enabling voltage to said first sustain electrode, and wherein said output for disabling provides a disabling voltage to said second sustain electrode.

12. The circuit of claim 11, wherein said enabling voltage is referenced to a scan electrode voltage, and wherein said disabling voltage, when referenced to said scan electrode voltage, is a lower magnitude than said enabling voltage.

13. The circuit of claim 8, wherein said first sustain electrode is addressed during a first portion of an addressing period, and wherein said second sustain electrode is addressed during a second portion of said addressing period.

14. The circuit of claim 13, wherein said first portion of said addressing period is a first half of said addressing period, and wherein said second portion of said addressing period is a second half of said addressing period.

15. A system, comprising:

a plasma display panel (PDP) having a first sustain electrode and a second sustain electrode adjacent to said first sustain electrode; and a circuit for (a) enabling said first sustain electrode to produce an addressing discharge, and (b) disabling said second sustain electrode when said first sustain electrode is producing said addressing discharge.

16. The PDP system of claim 15, wherein said first sustain electrode is in a first row of said PDP, and said second sustain electrode is in a second row of said PDP.

17. The PDP system of claim 15, wherein said enabling allows said first electrode to produce a sustain discharge during a sustain period, and wherein said disabling prevents said second sustain electrode from producing a sustain discharge during said sustain period.

18. The PDP system of claim 15, wherein said enabling provides an enabling voltage to said first sustain electrode, and wherein said disabling provides a disabling voltage to said second sustain electrode.

19. The PDP system of claim 18, wherein said enabling voltage is referenced to a scan electrode voltage, and wherein said disabling voltage, when referenced to said scan electrode voltage, is a lower magnitude than said enabling voltage.

20. The PDP system of claim 15, wherein said first sustain electrode is addressed during a first portion of an addressing period, and wherein said second sustain electrode is addressed during a second portion of said addressing period.

21. The PDP system of claim 20, wherein said first portion of said addressing period is a first half of said addressing period, and wherein said second portion of said addressing period is a second half of said addressing period.

* * * * *